US006224176B1

(12) United States Patent
Suzuki

(10) Patent No.: US 6,224,176 B1
(45) Date of Patent: May 1, 2001

(54) KITCHEN CABINET

(75) Inventor: Hiroshi Suzuki, Bisai (JP)

(73) Assignee: Beltecno Company (JP)

( * ) Notice: Subject to any disclaimer, the term of this patent is extended or adjusted under 35 U.S.C. 154(b) by 0 days.

(21) Appl. No.: 09/493,106

(22) Filed: Jan. 28, 2000

(30) Foreign Application Priority Data

Sep. 17, 1999 (JP) ..... 11-263755

(51) Int. Cl.[7] ..... A47B 97/00
(52) U.S. Cl. ..... 312/278; 312/330.1
(58) Field of Search ..... 312/278, 279, 312/330.1, 348.2, 348.3, 348.4, 334.7, 204, 228, 229

(56) References Cited

U.S. PATENT DOCUMENTS

| | | | | |
|---|---|---|---|---|
| 2,320,556 | * | 6/1943 | Belshaw | 312/278 X |
| 3,779,624 | * | 12/1973 | Werderitsch | 312/278 |
| 5,277,487 | * | 1/1994 | Simon | 312/278 |
| 5,466,061 | * | 11/1995 | Lautenschlager | 312/348.4 X |
| 5,525,002 | * | 6/1996 | Huber | 312/348.2 X |

FOREIGN PATENT DOCUMENTS

| | | | | |
|---|---|---|---|---|
| 579071 | * | 8/1941 | (GB) | 312/278 |
| 5-309022 | | 11/1993 | (JP) . | |
| 10-108748 | | 4/1998 | (JP) . | |
| 10-117866 | | 5/1998 | (JP) . | |

* cited by examiner

*Primary Examiner*—James O. Hansen
(74) *Attorney, Agent, or Firm*—Parkhurst & Wendel LLP

(57) ABSTRACT

A kitchen cabinet has a cabinet frame having a storage space portion that is accessible via a front door or the like and, above the storage space portion, a mounting portion for a sink, a cooking table surface, a gas stove or the like and, below the storage space portion, a drawer space that is open forward. A drawer is slidably fitted into the drawer space of the cabinet frame. Each of two side plate portions of the cabinet frame has, at its front lower end, a cutout that is receded from the upper front edge of the side plate, which defines a standard front surface of the kitchen cabinet. The drawer has a stepped front plate that is formed by connecting a lower front plate portion whose height is less than the height of the cutouts, to an upper front plate portion positioned forward of the lower front plate portion, by a connecting member. A lower edge portion of the upper front plate portion is formed as a hand hold portion. The kitchen cabinet allows, due to the cutout space, a user to place the user's toes inwardly of the standard front surface, and allows a lower space portion of the cabinet to be effectively utilized as a storage space.

9 Claims, 6 Drawing Sheets

KITCHEN CABINET

BACKGROUND OF THE INVENTION

1. Field of the Invention

The present invention relates to a kitchen cabinet and, more particularly, to a kitchen cabinet having a drawer-housing space at a bottom of an interior of the cabinet.

2. Description of the Related Art

It is desirable that a kitchen cabinet have a front bottom cutout formed by receding a front bottom end of the cabinet from a standard front surface of the cabinet. The cutout allows a user standing in front of the cabinet for, for example, cooking, to place the user's toes inwardly of the standard front surface of the cabinet. In a related kitchen cabinet art described in, for example, Japanese Utility Model Application Laid-Open No. HEI 7-27460, a base frame whose front surface is receded from a standard front surface of a cabinet is provided beneath the cabinet so as to form, at the bottom of the cabinet, a space in which a user can place the user's toes. Since the cabinet body is placed on top of the base frame, an internal space of the cabinet body itself can be utilized to store various articles. However, an internal space of the base frame is closed to the outside, so that the internal space of the base frame cannot be used to store articles. That is, the space is wasted.

SUMMARY OF THE INVENTION

Accordingly, the invention is intended to solve the above-described problem of the conventional kitchen cabinets. It is an object of the invention to provide a low-cost and simply constructed kitchen cabinet that has a cutout portion which allows a user to place the user's toes inwardly of a standard front surface of the cabinet without requiring a base frame and that makes it possible to effectively use a bottom space of the cabinet as a storage space To achieve the aforementioned and other objects, the invention provides a kitchen cabinet including a cabinet frame including opposite side surfaces, and a front surface having, at a lowermost portion thereof, an opening, the cabinet frame defining a drawer space that is open to an outside via the opening, and a drawer being slidably fittable into the drawer space of the cabinet frame via the opening. A lower end portion of a front surface of the drawer is formed so that when the drawer is fitted into the drawer space, the lower end portion of the front surface of the drawer is positioned rearward of the front surface of the cabinet frame.

Therefore, the kitchen cabinet of the invention provides a cutout space that allows a user to place the user's toes inwardly of a standard front surface of the kitchen cabinet, without employing a base frame as employed in the related-art kitchen cabinets. Furthermore, the kitchen cabinet of the invention allows a lowermost space portion of the cabinet to be effectively utilized as a storage space.

In the kitchen cabinet of the invention, the drawer may have a lower front plate portion that is provided at the lower portion of the drawer so that when the drawer is fitted into the drawer space, the lower front plate portion is positioned rearward of the front surface of the cabinet frame, and an upper front plate portion located forward of the lower front plate portion. The lower front plate portion and the upper front plate portion may be interconnected by a connecting member that extends in a front-rear direction.

Furthermore, the cabinet frame may have a cutout portion that is formed by receding a lower portion of a front end of each side surface of the cabinet frame from an upper front edge of the side surface. A depth of the cutout portion of the cabinet frame measured in a front-rear direction may be substantially equal to a distance between the lower front plate portion and the upper front plate portion of the drawer measured in the front-rear direction.

Still further, the kitchen cabinet may further include receptacle rails extending in a front-rear direction on inner surfaces of side plate portions of the cabinet frame. The receptacle rails support the drawer so that lower surfaces of a drawer body of the drawer do not contact any undesired members or objects. Further, the cabinet frame may include a foot member extending at a front lower end of the cabinet frame so as to serve as a stopper for the drawer.

BRIEF DESCRIPTION OF THE DRAWINGS

The foregoing and further objects, features and advantages of the present invention will become apparent from the following description of a preferred embodiment with reference to the accompanying drawings, wherein like numerals are used to represent like elements and wherein.

DETAILED DESCRIPTION OF PREFERRED EMBODIMENT

A preferred embodiment of the invention will be described hereinafter with reference to the accompanying drawings. The invention is not limited to the embodiment or constructions described below.

Figure 1:
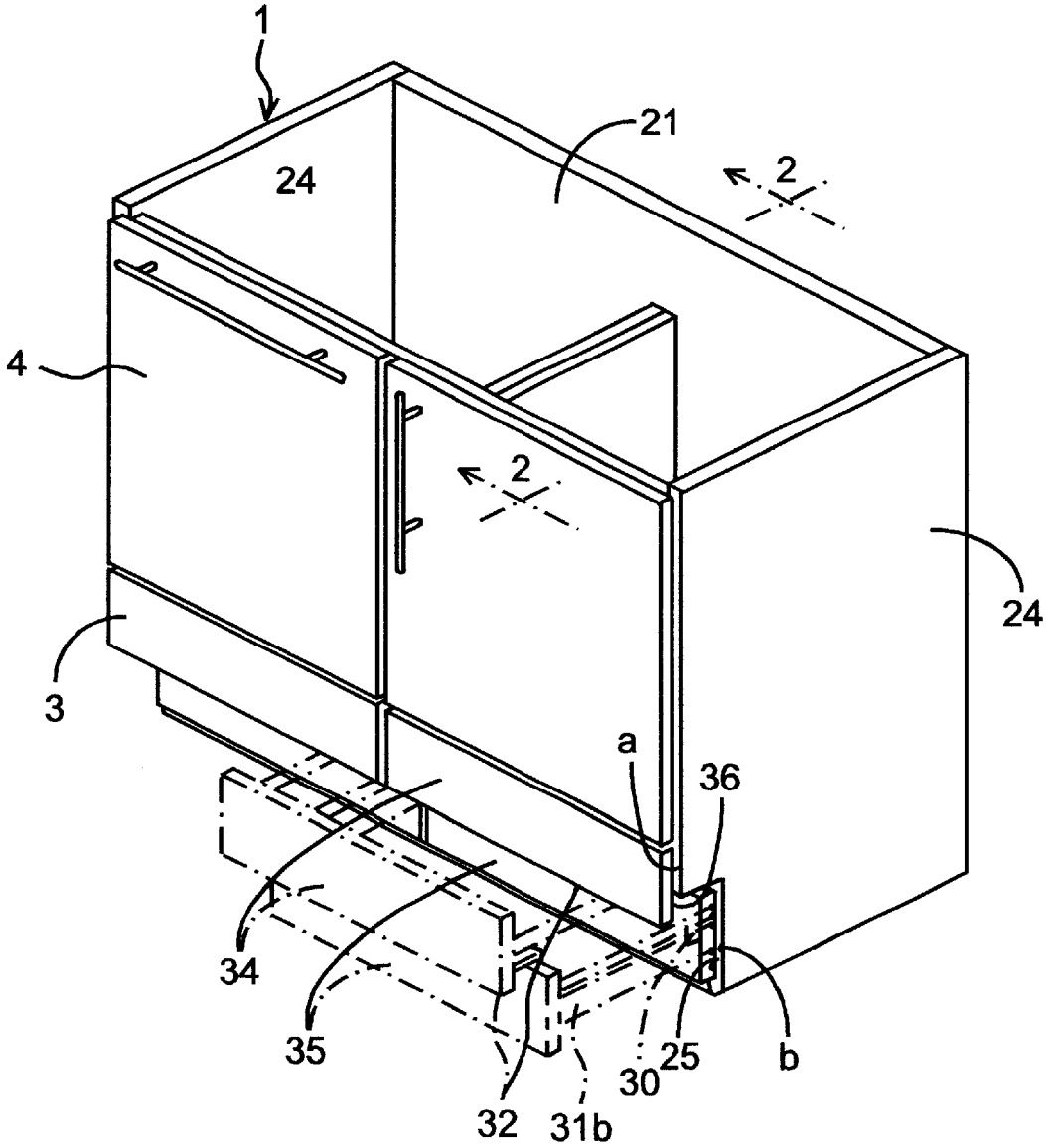
FIG. 1 is a perspective view of an embodiment of the kitchen cabinet of the invention.
Figure 2:
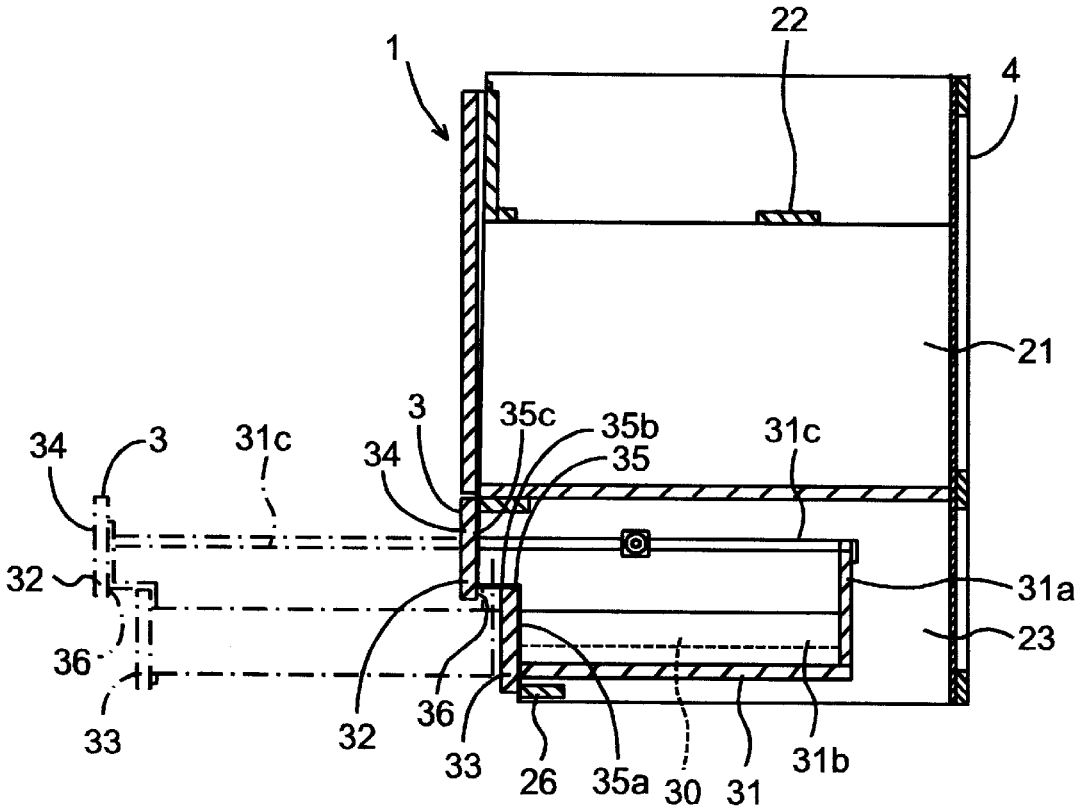
FIG. 2 is a sectional view taken on line 2—2 of FIG. 1.

FIG. 1 is a perspective view of a kitchen cabinet 1 according to an embodiment of the invention. FIG. 2 is a section taken on line 2—2 in FIG. 1. An integrated kitchen sink/stove system may be formed by arranging a plurality of kitchen cabinets similar to the kitchen cabinet 1. The kitchen cabinet 1 has a cabinet frame 4 and a drawer 3 provided in a lower portion of the cabinet frame 4.

The cabinet frame 4 of the kitchen cabinet 1 has a storage space 21 that is accessibly closed by a front surface door or the like and, above the storage space 21, a kitchen device-mounting portion 22 for receiving a sink, a cooking table surface, a gas stove, or various other kitchen devices. The cabinet frame 4 further has, in its lowermost portion, a drawer space 23 that is open forward. The drawer 3 is slidably fitted into the drawer space 23 of the cabinet frame 4.

Figure 3:
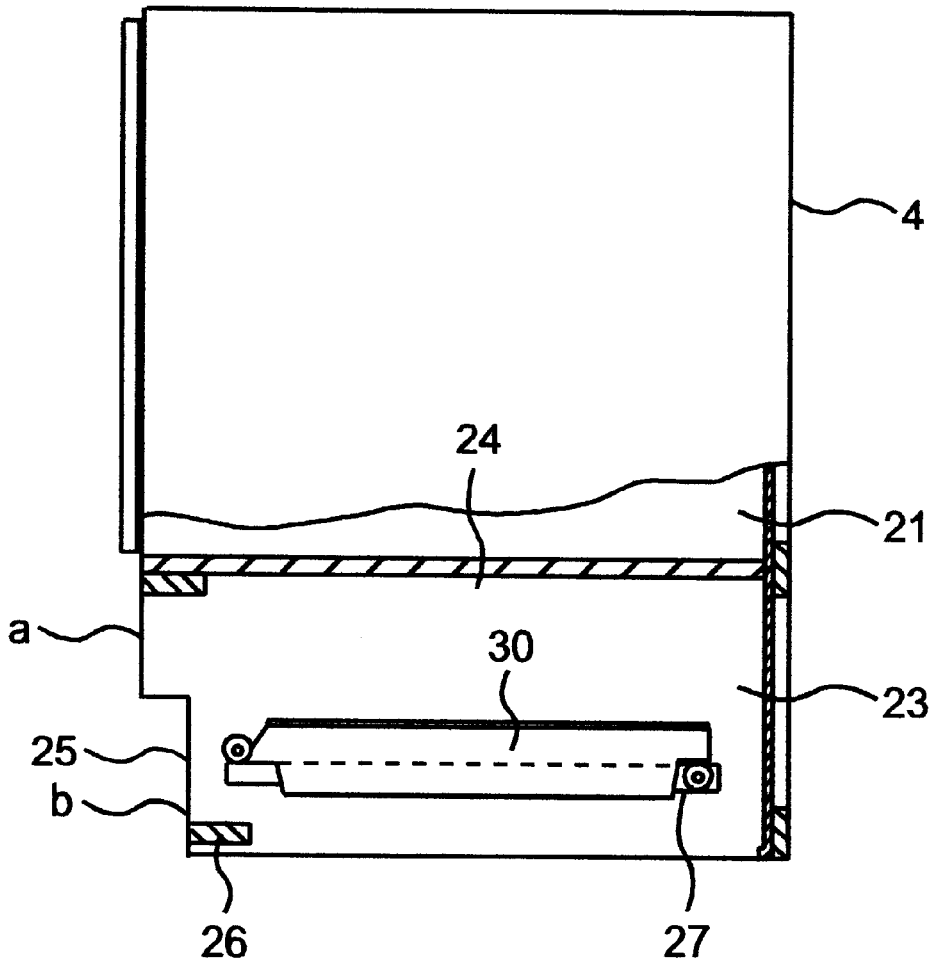
FIG. 3 is a fragmentary partial view showing a cabinet frame.
Figure 4:
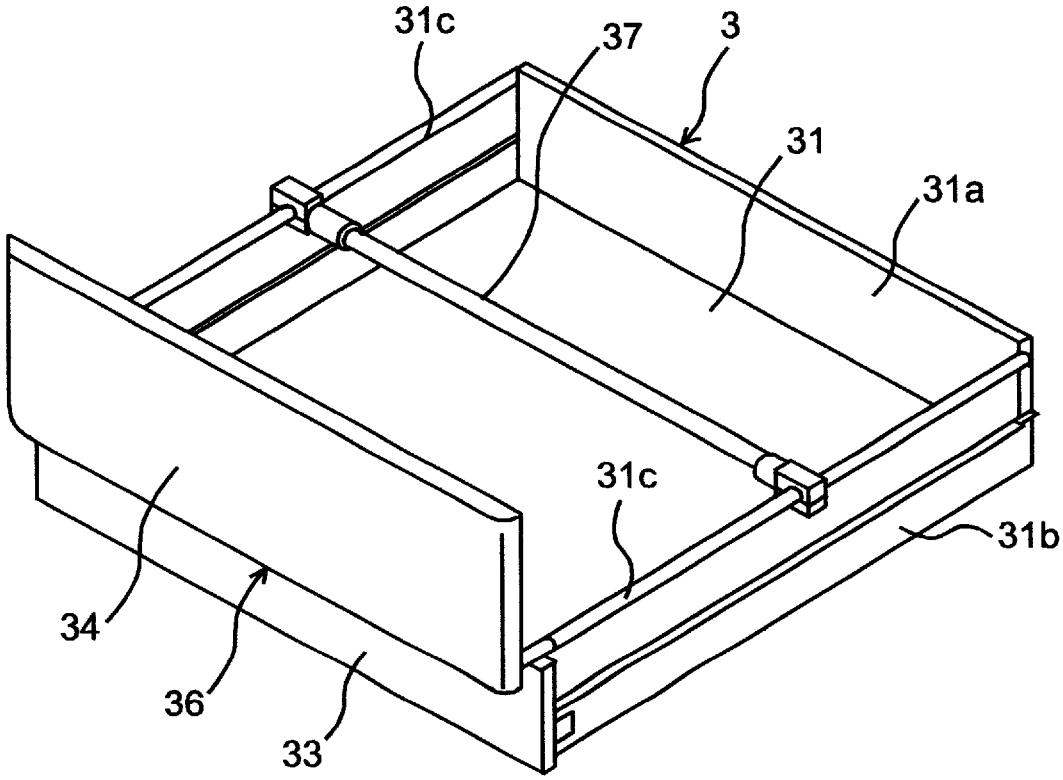
FIG. 4 is a perspective view of a drawer.

As shown in FIG. 3, a lower portion of a front edge of each side plate portion 24, 24 of the cabinet frame 4 has a rectangular cutout 25, 25 having a height of, for example, about 15 cm, and a depth of, for example, about 6 cm. In each side plate portion 24, a front edge b of the cutout 25 is formed rearward of an upper front edge a of the side plate portion 24, which partially defines a standard front surface of the cabinet frame 4. As shown in FIG. 4, the drawer 3 has a lower front plate portion 33 that has a height less than the height of the cutouts 25, 25 and that is fixed to a drawer body 31. The lower front plate portion 33 is connected to an upper front plate portion 34 disposed upwardly forward of the lower front plate portion 33, by a connecting member 35 that faces forward, thereby forming a stepped front plate 32. A distance between the lower front plate portion 33 and the upper front plate portion 34 of the drawer 3 measured in front-rear directions is set equal to the front-rear depth of the cutouts 25, 25 formed in a lower portion of a front end of the cabinet frame 4. A lower end portion of the upper front plate portion 34 is designed to serve as a hand hold portion 36 of the drawer 3.

FIG. 3 is a sectional view of the kitchen cabinet 1, wherein the drawer 3 has been removed from the cabinet frame 4. FIG. 4 is a perspective view of the drawer 3 taken out of the cabinet frame 4. In this embodiment, side plate portions 31*b* of the drawer body 31 of the drawer 3 have a height that is slightly less than the height of the lower front plate portion 33, and a rear plate portion 31*a* of the drawer body 31 has a height that is greater than the height of the side plate portions 31*b*. Side bars 31*c* extend in parallel to each other in the front-rear directions with respect to the drawer 3 between the upper front plate portion 34 and upper end portions of opposite sides of the rear plate portion 31*a*. A partition member 37 is connected to the two side bars 31*c* so that the partition member 37 can be slid forward and rearward on the bars 31*c* serving as guide members. The partition member 37 can be used to hold articles stored in the drawer body 31 and to prevent the articles from falling down. It is also possible to provide a plurality of partition members 37.

The connecting member 35 in this embodiment is a stainless steel plate member having a vertical leg plate portion 35*a,* a horizontal plate portion 35*b* extending forward from an upper portion of the leg plate portion 35*a,* and a vertically standing plate portion 35*c* extending upward from a forward portion of the horizontal plate portion 35*b*. The vertical leg plate portion 35*a* of the connecting member 35 is secured to an inner surface of the lower front plate portion 33 so that the horizontal plate portion 35*b* extends forward along an upper edge surface of the lower front plate portion 33. The vertically standing plate portion 35*c* of the connecting member 35 is secured to an inner surface of the upper front plate portion 34 so that the horizontal plate portion 35*b* is positioned slightly above a lower edge of the upper front plate portion 34. By positioning the horizontal plate portion 35*b* of the connecting member 35 slightly above the lower edge of the upper front plate portion 34 in that manner, a lower end portion of the upper front plate portion 34 becomes able to serve as the pullout hand hold portion 36.

In the embodiment shown in the drawings, an inner surface of each side plate portion 24, 24 of the cabinet frame 4 is provided with receptacle rails 27 that extend in the front-rear directions and are fixed to the inner surface. An upper edge portion of each side plate portion 31*b* of the drawer 3 is bent outward. Slide assist members 30 incorporating rollers are provided between the receptacle rails 27 and the side plate portions 31*b* of the drawer 3. Therefore, the drawer 3 is supported so as to be smoothly slid. In a front lower end portion of the cabinet frame 4, a foot member 26 having a thickness of about 1 cm extends between the side plate portions 24, 24. A lower edge of the lower front plate portion 33 of the drawer body 31 is located slightly below a bottom surface of the drawer body 31. Therefore, when the drawer 3 is pushed into the drawer space 23, a back surface of the upper front plate portion 34 and a back surface of the lower front plate portion 33 contact a front opening edge of the drawer space 23 and the foot member 26, respectively. Thus, those portions of contact serve as stoppers for the drawer 3.

Figure 5:
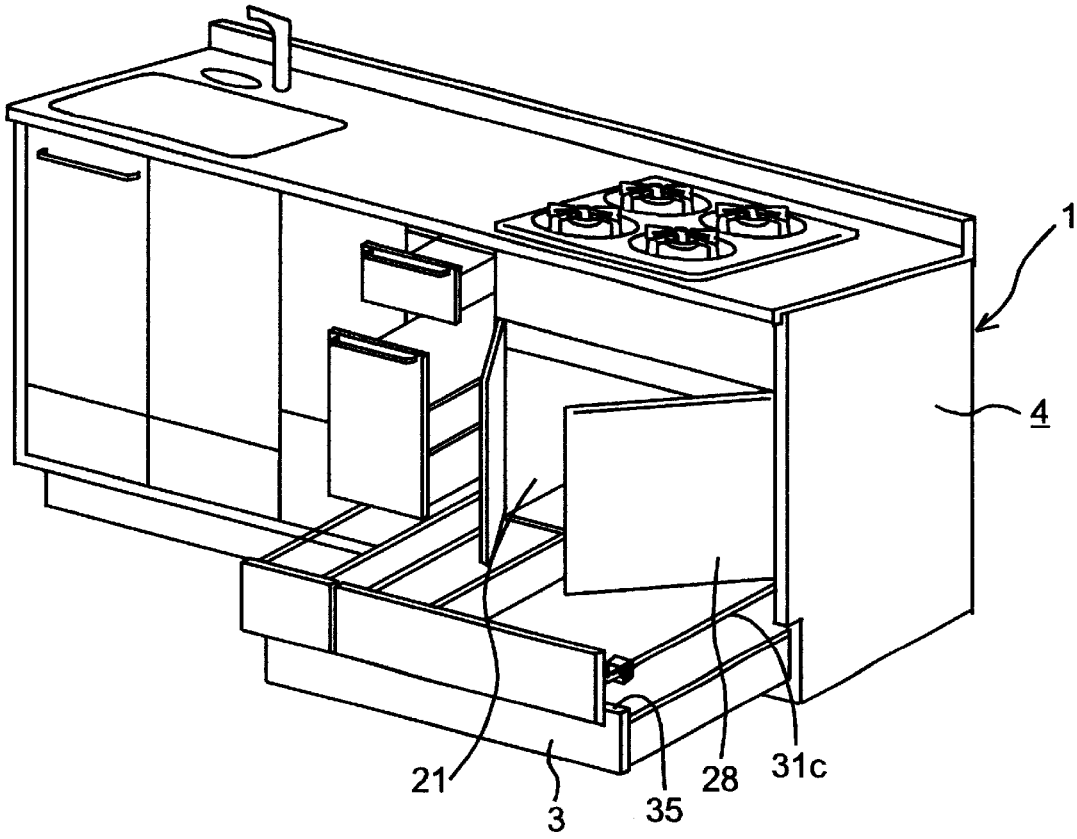
FIG. 5 is a perspective view of a kitchen system incorporating a plurality of kitchen cabinets according to the invention.
Figure 6:
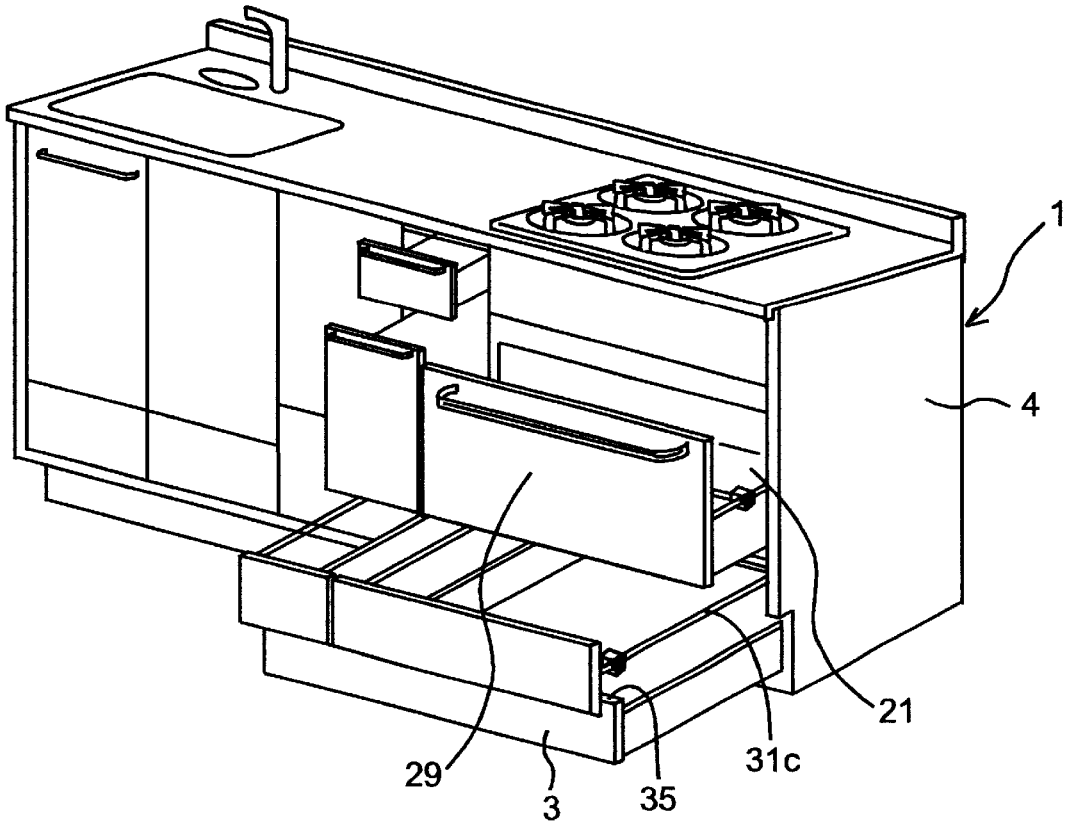
FIG. 6 is a perspective view of another kitchen system incorporating a plurality of kitchen cabinets according to the invention.

The thus-constructed kitchen cabinet according to the invention may be designed so that a sink, a cooking table surface, a gas stove, or other kitchen devices can be mounted to a top portion of the kitchen cabinet. Therefore, by arranging such kitchen cabinets according to the invention in a desired manner, an integrated kitchen system, such as ones that are shown in FIG. 5 and 6, can be formed. A kitchen cabinet 1 shown in FIG. 5 has a construction in which the storage portion 21 of the cabinet frame 4 has, at its front end, a set of double doors 28. A kitchen cabinet 1 shown in FIG. 6 has a construction in which the storage portion 21 of the cabinet frame 4 is provided in the form of a drawer 29. Thus, the storage portion or space 21 may be formed in any manner.

In this invention, the side plate portions 24 of the cabinet frame 4 have, in their front lower end portions, the cutouts 25 and, therefore, the front edges b of the cutouts 25 are receded from the upper front edges a of the side plate portions 24, which define a standard front surface of the kitchen cabinet 1. Furthermore, the drawer 3, slidably fitted into the drawer space 23, is provided with the stepped front plate 32 formed by connecting the lower front plate portion 33, whose height is less than the height of the cutouts 25, to the upper front plate portion 34 by the forward-facing connecting member 35. Therefore, when the drawer 3 is pushed in so that the lower front plate portion 33 of the drawer 3 contacts the front edges b of the cutouts 25, a space is formed at a front lower end portion of the kitchen cabinet 1 so as to allow a user to place the user's toes inwardly of the standard front surface of the kitchen cabinet 1. Thus, the kitchen cabinet of the invention provides a toe space substantially the same as the cutout or receded portion of the related art.

In the invention, however, the cutout space is formed by the lower front plate portion 33 of the drawer 3, not by a base frame employed in the related art. Therefore, the invention does not waste a space in a lower portion of the kitchen cabinet 1, but allows the space to be effectively utilized as a storage space. Still further, since the hand hold portion 36 of the drawer 3 is formed by a lower end portion of the upper front plate 34, a good appearance is achieved and the number of components of the kitchen cabinet 1 is reduced. Further, since the drawer 3 is supported by the receptacle rails 27, which extend in the front-rear direction on the inner surfaces of the side plate portions 24, via the sliding assist members 30, in such a manner that lower surfaces of the drawer body 31 will not contact any undesired members or objects, the drawer 3 can be smoothly pulled out and pushed in.

In the foregoing embodiment, the foot member 26 extends in a front lower end portion of the cabinet frame 4. The foot member 26 serves as a stopper for the drawer 3 and also fills in a gap between a lower end of the kitchen cabinet I and an installation surface. Thus, provision of the foot member 26 is preferable.

As is apparent from the above description, the invention advantageously allows effective utilization of a lower space portion of the kitchen cabinet as a storage space, and provides a cutout space that allows a user to place the user's toes inwardly of the standard front surface of the kitchen cabinet without using a base frame. Thus, the invention solves the aforementioned problems of the related-art kitchen cabinets, and advantageously achieves a simple construction and a low production cost.

While the present invention has been described with reference to what is presently considered to be a preferred embodiment thereof, it is to be understood that the present invention is not limited to the disclosed embodiment or constructions. On the contrary, the present invention is intended to cover various modifications and equivalent arrangements.

What is claimed is:

1. A kitchen cabinet comprising:

a cabinet frame including opposite side surfaces, and a front surface having, at a lowermost portion thereof, an opening, the cabinet frame defining a drawer space that is open to an outside via the opening; and a drawer slidably filtrable into the drawer space of the cabinet frame via the opening, the drawer including (1) a lower front plate portion that is provided at a lower portion of the drawer so that when the drawer is fitted into the drawer space, the lower front plate portion is positioned rearward of the front surface of the cabinet frame, and (2) an upper front plate portion located forward of the lower front plate portion, the lower front plate portion and the upper front plate portion being interconnected by a connecting member that extends in a front-rear direction of the drawer, said connecting member comprising a vertical leg plate portion, a horizontal plate portion extending forward from an upper portion of the vertical leg plate portion, and a vertically standing plate portion extending upward from a forward portion of the horizontal plate portion, the lower end portion of the front surface of the drawer being formed so that, when the drawer is fitted into the drawer space, the lower end portion of the front surface of the drawer is positioned rearward of the front surface of the cabinet frame.

2. A kitchen cabinet according to claim 1, wherein the cabinet frame comprises a cutout portion that is formed by receding a lower portion of a front end of each side surface of the cabinet frame from an upper front edge of the side surface.

3. A kitchen cabinet according to claim 2, wherein a depth of the cutout portion of the cabinet frame measured in a front-rear direction is substantially equal to a distance between the lower front plate portion and the upper front plate portion of the drawer measured in the front-rear direction.

4. A kitchen cabinet according to claim 1, wherein a lower edge of the upper front plate portion of the drawer is protruded downward of a substantially horizontal plate portion of the connecting member so as to form a hand hold portion of the drawer.

5. A kitchen cabinet according to claim 1, wherein the drawer comprises:

bar members extending in parallel between opposite side end portions of the upper front plate portion and upper end portions of opposite side end portions of a rear plate portion of the drawer; and a partition member fitted to the bar members so that the partition member is slidable forward and rearward using the bar members as guides.

6. A kitchen cabinet according to claim 1, wherein the cabinet frame comprises a cutout portion that is formed by receding a lower portion of a front end of each side surface of the cabinet frame from an upper front edge of the side surface.

7. A kitchen cabinet according to claim 1, further comprising receptacle rails extending in a front-rear direction on inner surfaces of side plate portions of the cabinet frame, so as to support the drawer.

8. A kitchen cabinet according to claim 1, wherein the cabinet frame comprises a foot member extending at a front lower end of the cabinet frame so as to serve as a stopper for the drawer.

9. A kitchen cabinet according to claim 1, wherein a storage space portion is formed above the drawer space, the front surface of the cabinet frame being capable of being opened and closed for the storage space portion.

* * * * *